US005292201A

United States Patent [19]

Yano

[11] Patent Number: 5,292,201

[45] Date of Patent: Mar. 8, 1994

[54] PRINTING HEAD OF WIRE-DOT IMPACT PRINTER

[75] Inventor: Akio Yano, Kawasaki, Japan

[73] Assignee: Fujitsu Limited, Kawasaki, Japan

[21] Appl. No.: 977,027

[22] Filed: Nov. 16, 1992

[30] Foreign Application Priority Data

Nov. 18, 1991 [JP] Japan ..... 3-301437

[51] Int. Cl.[5] ..... B41J 2/295

[52] U.S. Cl. ..... 400/124; 101/93.05

[58] Field of Search ..... 400/124, 124 PZ; 101/93.05

[56] References Cited

U.S. PATENT DOCUMENTS 4,787,760 11/1988 Nasegawa ..... 400/124
4,874,978 10/1989 Sakaida et al. ..... 400/124
5,005,994 4/1991 Yano .
5,078,520 1/1992 Yano et al. .
5,092,689 3/1992 Yano .

FOREIGN PATENT DOCUMENTS 0352075 1/1990 European Pat. Off. ..... 400/124
0188353 7/1989 Japan ..... 400/124
0275150 11/1989 Japan ..... 400/124
0055149 2/1990 Japan ..... 400/124

*Primary Examiner*—Edgar S. Burr
*Assistant Examiner*—John S. Hilten
*Attorney, Agent, or Firm*—Armstrong, Westerman, Hattori, McLeland & Naughton

[57] ABSTRACT

A printing head including a plurality of impact printing wires constituting a dot matrix and a plurality of actuators for respectively and selectively driving the printing wires. Each actuator is constituted of a movable member to which the printing wire corresponding thereto is connected, a base member, a piezoelectric device mounted on the base member, and first and second leaf springs. The first leaf spring is connected between the movable member and the piezoelectric device, and the second leaf spring is connected between the movable member and the base member in parallel relationship to the first leaf spring. Each of the first and second leaf springs has a shape such that it is narrowest at the central portion thereof and is gradually widened toward the opposite ends thereof. Owing to this shape, a stress generating at the opposite ends of each leaf spring can be reduced to thereby prevent breakage of each leaf spring.

2 Claims, 3 Drawing Sheets

PRINTING HEAD OF WIRE-DOT IMPACT PRINTER

BACKGROUND OF THE INVENTION

1. Field of the Invention

The present invention relates to a printing head of a wire-dot impact printer.

2. Description of the Related Art

Recently, a high-speed printing capability of a wire-dot impact printer has been accompanied by the use of a laminated piezoelectric device for driving of printing wires provided in a printing head. The laminated piezoelectric device includes a plurality of internal electrodes and a pair of external electrodes for connecting the internal electrodes, and it is driven at a high voltage under severe conditions to therefore require a high reliability.

A wire-dot impact printer employing such a piezoelectric device is described in U.S. Pat. No. 5,005,994, for example, issued Apr. 9, 1991 to Akio Yano. A printing head of the wire-dot impact printer described in this patent is constituted of a frame, a plurality of impact printing wires constituting a wire-dot matrix, and a plurality of actuators for respectively and selectively driving the impact printing wires.

Each actuator is constituted of a displacement enlarging mechanism, a laminated piezoelectric device, a base for connecting the displacement enlarging mechanism to the laminated piezoelectric device, and a movable block fixed to one end of the piezoelectric device. The displacement enlarging mechanism is constituted of an armature and a pair of leaf springs disposed in parallel relationship to each other for supporting one end portion of the armature. The piezoelectric device is fixed at its other end to the base. One of the leaf springs is connected between the armature and the movable block, and the other leaf spring is connected between the armature and the base. The impact printing wire is fixed to the other end portion of the armature.

In printing, a driving voltage is applied to the piezoelectric device to generate a strain of tens of μm in the piezoelectric device and thereby push the movable block. As a result, the armature is swung about a lower end portion thereof by a bimetal effect of the pair of leaf springs, and the displacement of the movable block is therefore enlarged to project the printing wire in an amount of hundreds of μm. Then, the printing wire is impacted against a platen through an ink ribbon and a printing paper to form a dot print on the printing paper.

FIG. 1 shows a shape and a stress distribution of each leaf spring 2 used in the prior art printing head. As apparent from FIG. 1, the shape of the leaf spring 2 is rectangular, and the distribution of a stress generating in the leaf spring 2 in operating the piezoelectric device is such that the stress is very high at the opposite ends of the leaf spring 2 and it is low at the central portion of the leaf spring 2. As mentioned above, one of the leaf springs is fixed at its opposite ends to the armature and the movable block, and the other leaf spring is fixed at its opposite ends to the armature and the base. Accordingly, when the piezoelectric device is driven, the stress generating at the opposite ends of each leaf spring becomes very high to cause a defect that each leaf spring is broken at the fixed portions. The breakage of the leaf springs occurs at the fixed portions to the movable block and the base more frequently than at the fixed portions to the armature.

SUMMARY OF THE INVENTION

It is therefore an object of the present invention to provide a printing head of a wire-dot impact printer which can prevent the breakage of the leaf springs to improve a reliability.

In accordance with an aspect of the present invention, there is provided a printing head comprising a frame, a plurality of impact printing wires constituting a wire-dot matrix, and a plurality of actuators respectively corresponding to, and for selectively driving, said respective impact printing wires; each of said actuators comprising a movable member having one end to which the respective one of said impact printing wires is connected; a piezoelectric device having a first end connected to said frame and a second end, said piezoelectric device being responsive to selective application of an electrical voltage thereto to undergo longitudinal expansion and contraction; a first leaf spring having a first end fixedly connected to the second end of said piezoelectric device and a second end fixedly connected to said movable member adjacent to the other end thereof, width of said first leaf spring being narrower at a central portion thereof and being gradually increased toward said first and second ends of said first leaf spring; and a second leaf spring disposed in substantially parallel relationship to said first leaf spring and having a first end fixedly connected to said frame and a second end fixedly connected to said movable member adjacent to the other end thereof so that the extent of longitudinal expansion and contraction of said piezoelectric device in response to the selective application of an electrical voltage thereto is enlarged by said movable member and transmitted thereby to said impact printing wire, width of said second leaf spring being narrower at a central portion thereof and being gradually increased toward said first and second ends of said second leaf spring.

Since the first and second leaf springs are shaped as mentioned above, a stress generating at the opposite ends of each leaf spring is dispersed to the central portion thereof. Therefore, a maximum stress generating in each leaf spring can be lowered to thereby prevent breakage of each leaf spring and improve a reliability of the printing head.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 2:
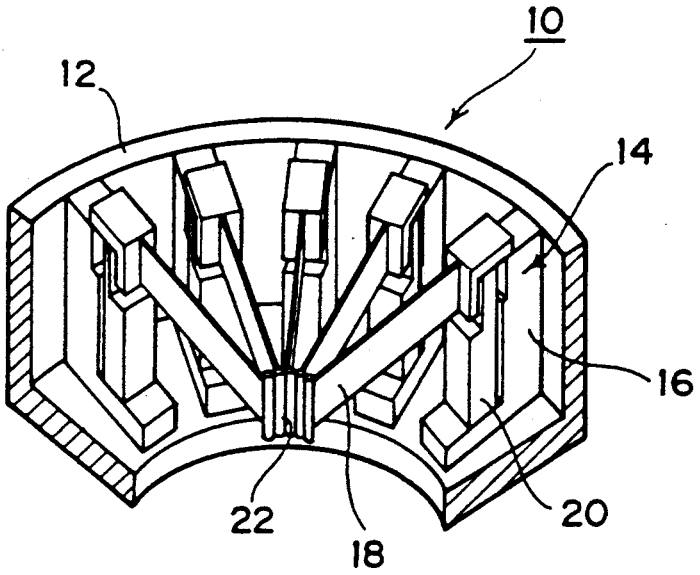
FIG. 2 is a partially cutaway perspective view of a printing head having a plurality of actuators for respectively driving a plurality of dot impact printing wires.

There will first be described a general construction of a printing head of a dot impact printer according to a preferred embodiment of the present invention with reference to FIG. 2. A printing head 10 is constituted of a cylindrical housing 12 and a plurality of actuators 14 arranged in the cylindrical housing 12. Each actuator 14 is constituted of a base member 16, a movable member 18, and a piezoelectric device assembly 20. A printing wire 22 is fixed to an end of the movable member 18.

Figure 3:
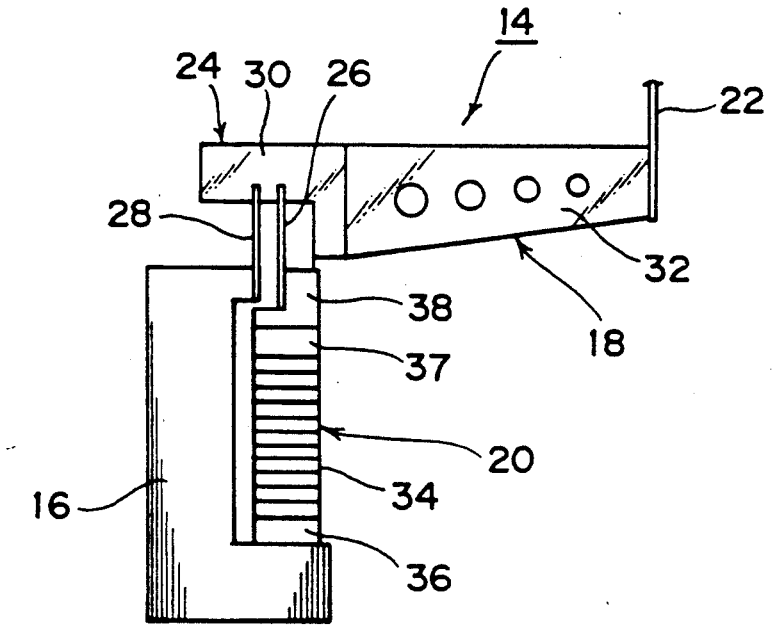
FIG. 3 is a side view of the actuator adopting leaf springs according to a preferred embodiment of the present invention.

A detailed structure of the actuator 14 will now be described with reference to FIG. 3. The movable member 18 is constituted of an armature 30 and a beam 32 brazed to the armature 30. The printing wire 22 is fixed to an end of the beam 32. A displacement enlarging mechanism 24 is constituted of the movable member 18 and a pair of leaf springs 26 and 28 disposed in substantially parallel relationship to each other. The piezoelectric device assembly 20 is constituted of a block 36 fixed to the base member 16, a piezoelectric device 34 fixed at its one end to the block 36, a block 37 fixed to the other end of the piezoelectric device 34, and a movable block 38 bonded to the block 37. One end of the leaf spring 26 is brazed to the movable block 38 of the piezoelectric device assembly 20, and the other end of the leaf spring 26 is brazed to the armature 30. On the other hand, one end of the leaf spring 28 is brazed to the base member 16, and the other end of the leaf spring 28 is brazed to the armature 30.

Figure 4:
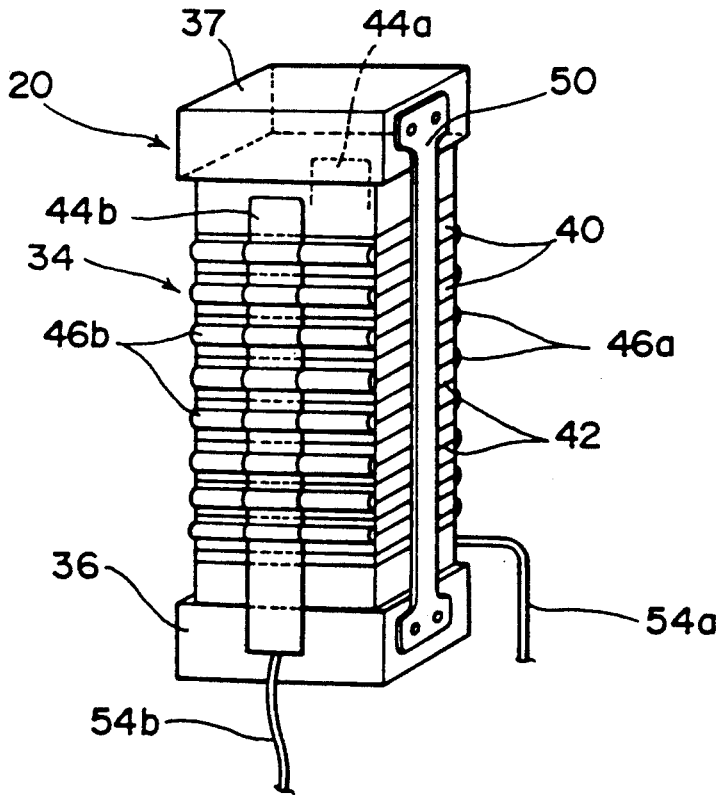
FIG. 4 is a perspective view illustrating a detailed structure of a laminated piezoelectric device employed in the actuator shown in FIG. 3.

As best shown in FIG. 4, the piezoelectric device assembly 20 includes a plurality of internal electrodes 42, a first external electrode **44*a*, and a second external electrode 44*b*. The piezoelectric device 34 is constituted of a plurality of laminated piezoelectric ceramics sheets 40 and the internal electrodes 42 each interposed between the adjacent ones of the laminated piezoelectric ceramics sheets 40. The internal electrodes 42 are grouped into first elements and second elements arranged in alternate relationship to each other. The first external electrode 44*a* is provided on a first side surface of the piezoelectric device 34 so as to be connected with the first elements of the internal electrodes 42. The second external electrode 44*b* is provided on a second side surface of the piezoelectric device 34 opposite to the first side surface thereof so as to be connected with the second elements of the internal electrodes 42. A plurality of first semicylindrical insulating layers 46*a* are arranged on the first side surface of the piezoelectric device 34 so as to electrically insulate the second elements of the internal electrodes 42 from the first external electrode 44*a*. Similarly, a plurality of second semicylindrical insulating layers 46*b* are arranged on the second side surface of the piezoelectric device 34 so as to electrically insulate the first elements of the internal electrodes 42 from the second external electrode 44*b*. The first external electrode 44*a* on a positive side is connected through a lead wire 54*a* to a positive electrode terminal of a driving circuit (not shown), and the second external electrode 44*b* on a negative side is connected through a lead wire 54*b* to the base member 16** grounded.

The laminated piezoelectric device 34 is manufactured by laminating a plurality of green sheets of piezoelectric ceramics, on one side surface of each green sheet being formed a metal paste film as each internal electrode 42, and by burning a laminated assembly thus obtained at a predetermined high temperature for a predetermined period of time. A pair of elastic plates 50 extend over the opposite side surfaces of the piezoelectric device 34 perpendicular to the first and second side surface thereof. One end of each elastic plate 50 is laser-welded to the block 36 fixed to one end of the piezoelectric device 34, and the other end of each elastic plate 50 is laser-welded to the block 37 fixed to the other end of the piezoelectric device 34, under the condition where a predetermined pressure is applied to the piezoelectric device 34 in a longitudinal direction thereof (i.e., in a direction of lamination of the piezoelectric device 34). The block 36 is bonded to the base member 16, and the block 37 is bonded to the movable block 38.

Figure 1:
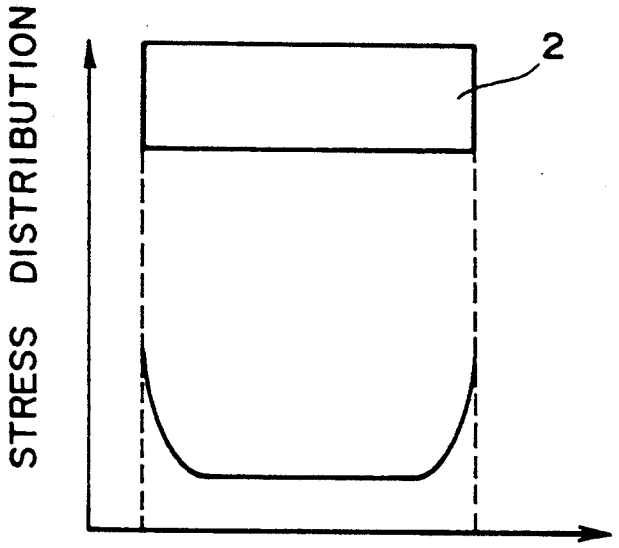
FIG. 1 PRIOR ART
FIG. 1 is a view illustrating a shape and a stress distribution of a leaf spring in the prior art.
Figure 5:
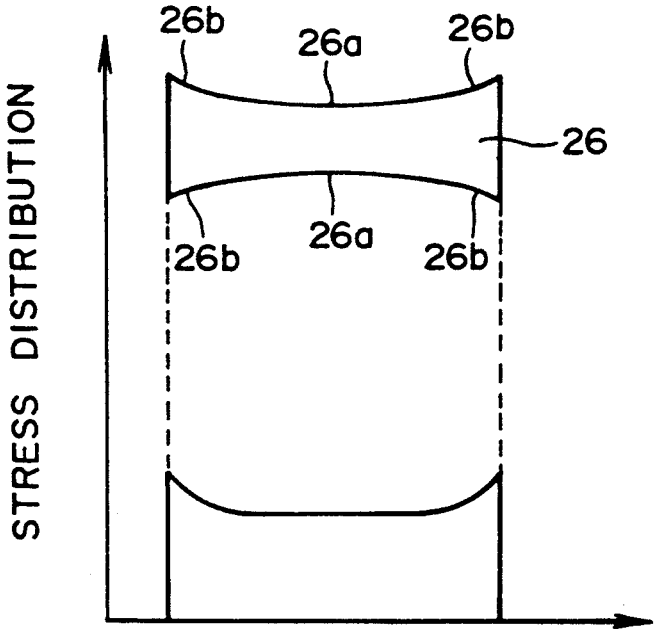
FIG. 5 is a view illustrating a shape and a stress distribution of each leaf spring shown in FIG. 3.

According to the present invention, it is featured that the leaf springs 26 and 28 constituting the displacement enlarging mechanism 24 are shaped as shown in FIG. 5, provided that the shape of the leaf spring 26 only is shown because the shape of the leaf spring 28 is similar to that of the former. As shown in FIG. 5, each side edge of the leaf spring 26 is contoured by an arc **26*a* having a very large radius of curvature and a pair of arcs 26*b* continuing from the opposite ends of the arc 26*a*, each arc 26*b* having a small radius of curvature. In other words, the leaf spring 26 has a varied width such that it is smallest at the central portion of the leaf spring 26 and is gradually increased toward the opposite ends thereof, then rapidly increased at the opposite ends to be brazed to the armature 30 and the movable block 38. When setting the width of the leaf spring 26 at the central portion thereof to be slightly smaller than that of the leaf spring 2** shown in FIG. 1, a spring rigidity of the former can be made substantially the same as that of the latter.

Owing to the specific shape of the leaf springs 26 and 28, a stress generating at the opposite ends of the leaf springs 26 and 28 when driving the laminated piezoelectric device 34 can be dispersed to the central portion of each leaf spring as shown in FIG. 5, thereby lowering a maximum stress generating in each leaf spring. Accordingly, breakage of the leaf springs 26 and 28 at their respective fixed portions can be prevented to thereby improve a reliability of the printing head.

What is claimed is:

1. A printing head comprising a frame, a plurality of impact printing wires constituting a wire-dot matrix, and a plurality of actuators respectively corresponding to, and for selectively driving, said respective impact printing wires; each of said actuators including:

a movable member having one end to which the respective one of said impact printing wires is connected;

a piezoelectric device having a first end connected to said frame and a second end, said piezoelectric device being responsive to selective application of an electrical voltage thereto to undergo longitudinal expansion and contraction;

a first leaf spring having a first end fixedly connected to the second end of said piezoelectric device and a second end fixedly connected to said movable member adjacent to the other end thereof, a width of said first leaf spring being narrower at a central portion thereof and being gradually increased toward said first and second ends of said first leaf spring;

a second leaf spring disposed in substantially parallel relationship to said first leaf spring and having a first end fixedly connected to said frame and a second end fixedly connected to said movable member adjacent to the other end thereof so that the extent of longitudinal expansion and contraction of said piezoelectric device in response to the selective application of an electrical voltage thereto is enlarged by said movable member and transmitted thereby to said impact printing wire, a width of said second leaf spring being narrower at a central portion thereof and being gradually increased toward said first and second ends of said second leaf spring;

said first and second leaf springs each have opposite side edges which are symmetrical with respect to a longitudinal center line of each said leaf spring, each side edge being contoured by a first arc having a large radius of curvature at the central portion of each said leaf spring and a pair of second arcs each having a small radius of curvature at said first and second ends of each said leaf spring; and said contoured side edges of both said first and second leaf springs face generally perpendicular to a length of said movable member which is defined between said one end of said movable member and said other end of said movable member.

2. A printing head according to claim 1, wherein each of said first and second leaf springs has a substantially uniform thickness across a width of said contoured side edges from a first side of the respective leaf spring facing said printing wire to a second side of the respective leaf spring facing opposite from said printing wire.

* * * * *